US010789893B1

(12) United States Patent
Xu

(10) Patent No.: US 10,789,893 B1
(45) Date of Patent: Sep. 29, 2020

(54) SCAN DRIVING CIRCUIT

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Jing Xu, Guangdong (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 260 days.

(21) Appl. No.: 16/089,083

(22) PCT Filed: Sep. 6, 2018

(86) PCT No.: PCT/CN2018/104455
§ 371 (c)(1),
(2) Date: Sep. 27, 2018

(87) PCT Pub. No.: WO2019/184253
PCT Pub. Date: Oct. 3, 2019

(30) Foreign Application Priority Data

Mar. 29, 2018 (CN) ..... 2018 1 0274334

(51) Int. Cl.
*G09G 3/3266* (2016.01)
*G09G 3/36* (2006.01)
(Continued)

(52) U.S. Cl.
CPC ..... *G09G 3/3266* (2013.01); *G09G 3/3225* (2013.01); *G09G 2310/0251* (2013.01); *G09G 2310/0286* (2013.01); *G09G 2310/08* (2013.01)

(58) Field of Classification Search
CPC ..... G09G 5/00; G09G 3/30; G09G 3/3225–3266; G09G 2310/0251–0286; G09G 2310/08
See application file for complete search history.

(56) References Cited

U.S. PATENT DOCUMENTS 8,077,168 B2 * 12/2011 Shin ..... G09G 3/3266 345/204
2005/0134545 A1 * 6/2005 Jang ..... G09G 3/3688 345/100
(Continued)

FOREIGN PATENT DOCUMENTS

CN 102547320 A 7/2012
CN 102576517 A * 7/2012 ..... G09G 3/3614
(Continued)

*Primary Examiner* — Lin Li
(74) *Attorney, Agent, or Firm* — Leong C. Lei

(57) ABSTRACT

The invention provides a scan driving circuit, comprising: a plurality of rows of output channels successively arranged, at least a first multiplex module, and at least a second multiplex module; the power end of the (4m−3)-th row of output channels receiving a first power signal, the power end of the (4m−2)-th row of output channels receiving an output end of one first multiplex module, the power end of the (4m−1)-th row of output channels receiving an output end of one second multiplex module, and the power end of the 4m-th row of output channel receiving a second power signal; the first and second multiplex modules having control ends receiving a selection signal, a first input end receiving the first power signal, and a second input end receiving the second power signal; the selection signal controlling the first and second multiplex modules to change respective output power signal.

16 Claims, 7 Drawing Sheets

(51) Int. Cl.
*G09G 3/3233* (2016.01)
*G09G 3/3225* (2016.01)

(56) References Cited

U.S. PATENT DOCUMENTS

| | | | | |
|---|---|---|---|---|
| 2005/0156862 | A1* | 7/2005 | Hirayama | G09G 3/3688 345/100 |
| 2013/0050161 | A1* | 2/2013 | Park | G09G 3/3266 345/204 |
| 2013/0097466 | A1 | 4/2013 | Whetsel | |
| 2015/0106646 | A1* | 4/2015 | Lee | G09G 3/3677 713/400 |
| 2016/0307529 | A1 | 10/2016 | Tseng et al. | |
| 2018/0005576 | A1* | 1/2018 | Yoon | G09G 3/3233 |
| 2019/0005884 | A1* | 1/2019 | Yoo | H01L 27/3276 |
| 2019/0259336 | A1* | 8/2019 | Miyasaka | G02B 27/017 |

FOREIGN PATENT DOCUMENTS

| | | | | |
|---|---|---|---|---|
| CN | 104036747 | A | 9/2014 | |
| CN | 105637578 | A | 6/2016 | |
| CN | 106771958 | A | 5/2017 | |
| CN | 108492784 | A | 9/2018 | |
| WO | WO 2018032568 | A1 * | 2/2018 | G09G 3/3677 |

* cited by examiner

SCAN DRIVING CIRCUIT

RELATED APPLICATIONS

The present application is a National Phase of International Application Number PCT/CN2018/104455, filed Sep. 6, 2018, and claims the priority of China Application No. 201810274334.6, filed Mar. 29, 2018.

BACKGROUND OF THE INVENTION

1. Field of the Invention

The present invention relates to the field of display techniques, and in particular to a scan driving circuit.

2. The Related Arts

The flat panel display device provides many advantages such as thinness, power saving, and radiation-free, and has been widely used. The known flat panel display device mainly comprises a liquid crystal display (LCD) element or an organic light-emitting diode (OLED) element.

Because the OLED display element shows excellent properties of self-luminescence, no backlight source, high contrast, thinness, wide viewing angle, fast response, flexibility for use in a panel, wide operating temperature range, and simple structure and manufacturing process, the OLED display is heralded as the mainstream technology for the next generation of display.

The OLED display device generally comprises a substrate, an anode disposed on the substrate, a light-emitting layer disposed on the anode, an electron transport layer disposed on the light-emitting layer, a cathode disposed on the electron transport layer. In operation, the holes from the anode and electrons from the cathode are emitted to the organic light emitting layer, these electrons and holes are combined to generate an excited electron-hole pair, and the excited electron-hole pair is converted from the excited state to the ground state to achieve light-emitting.

With the development of display technology, the frame rate of the display panel is increasingly higher, and the corresponding gate scanning frequency is also increasingly higher, which causes shorter opening time of the thin film transistor (TFT), and results in the shorter charging time of the pixel leading to insufficient charging. To solve the above problem, the prior art proposes a pre-charging method, which is to open and pre-charge the next row of pixels of the currently charged row of pixels, and then when scanning to the next row of pixels, the next row of pixels is charged on the pre-charge basis to avoid under-charging.

Moreover, to reduce the capacitive coupling effect when the TFT is turned off, the prior art also performs a chamfering process on the scan signal driving the TFT to switch on and off. Specifically, when the gate scan driving circuit (gate IC) performs level shifting on the scan signal, the power signal (VGH) used for level shifting is chamfered to generate a chamfered scan signal. At this point, chamfering also occurs in pre-charging the pixel, resulting in reduced pre-charge effect and affecting the charging effect of the pixels.

SUMMARY OF THE INVENTION

The object of the present invention is to provide a scan driving circuit, able to change the power signal received by the output channel based on requirement, to guarantee the pre-charge effect as well as applicable to the requirements of various kinds of scanning sequences.

To achieve the above object, the present invention provides a scan driving circuit, which comprises: an output module, the output module comprising a plurality of rows of output channels successively arranged, at least a first multiplex module, and at least a second multiplex module;

number of the first multiplex modules and number of second multiplex modules being equal;

each row of output channels comprising: an input end, a power end, and an output end, with the input end of each row of output channels connected to an input pulse signal corresponding to the row of output channels, the output end outputting a corresponding scan signal of the row of output channels, the power end of the (4m−3)-th row of output channels receiving a first power signal, the power end of the (4m−2)-th row of output channels receiving an output end of one first multiplex module, the power end of the (4m−1)-th row of output channels receiving an output end of one second multiplex module, and the power end of the 4m-th row of output channel receiving a second power signal, m being a positive integer;

each first multiplex module having a control end receiving a selection signal, a first input end receiving the first power signal, and a second input end receiving the second power signal; each second multiplex module having a control end receiving a selection signal, a first input end receiving the first power signal, and a second input end receiving the second power signal; each selection signal controlling the output end of each first multiplex module to output one of the first power signal and the second power signal, and controlling the output end of the second multiplex modules to output the other of the first power signal and the second power signal different from the output of the first multiplex module.

According to a preferred embodiment of the present invention, the scan driving circuit further comprises: a shift register and a logical control unit electrically connected respectively to the shift register and the output module;

the shift register receiving a clock signal and a scan start signal for generating a plurality of input pulse signals outputted to the logic control unit according to the clock signal and the scan start signal;

the logic control unit receiving an enable signal for correspondingly inputting the plurality of input pulse signals into respective output channels of the output module according to the enable signal.

According to a preferred embodiment of the present invention, the first power signal and the second power signal are both chamfered signals.

According to a preferred embodiment of the present invention, the first power signal and the second power signal generate a chamfering cycle equal to twice the period of the clock signal, and two adjacent chamfers located respectively on the first power signal and the second power signal differ by a cycle of one clock signal, and rising edge of each chamfer is generated correspondingly to a rising edge of the clock signal.

According to a preferred embodiment of the present invention, the scan driving circuit is configured to electrically connect to a pixel array, the pixel array comprises a plurality of pixel driving units arranged in an array.

According to a preferred embodiment of the present invention, each output channel corresponds to a row of pixel driving units, with each pixel driving unit comprising a switching thin film transistor (TFT), a driving TFT, a storage capacitor, and an organic light emitting diode (OLED);

the switching TFT having a gate electrically connected to the output end of the corresponding output channel of the pixel driving unit, a source receiving a data signal, and a drain electrically connected to a gate of the driving TFT; the driving TFT having a source receiving a high power voltage, and a drain electrically connected to an anode of the OLED; the storage capacitor having a first end electrically connected to the gate of the driving TFT and a second end electrically connected to the drain of the driving TFT; the OLED having a cathode connected to a low power voltage;

the selection signal being at a low voltage, the output end of each first multiplex module outputting the second power signal, and the output end of each second multiplex module outputting the first power signal.

According to a preferred embodiment of the present invention, the plurality of rows of output channels are divided into a plurality of output channel groups, with each output channel group having two adjacent rows of output channels starting from the first row of output channels; each output channel group corresponding to one row of pixel driving units;

each pixel driving unit comprising a switching thin film transistor (TFT), a driving TFT, a sensing TFT, a storage capacitor, and an organic light emitting diode (OLED);

the switching TFT having a gate electrically connected to the output end of one output channel in the corresponding output channel group of the pixel driving unit, a source receiving a data signal, and a drain electrically connected to a gate of the driving TFT; the driving TFT having a source receiving a high power voltage, and a drain electrically connected to an anode of the OLED; the sensing TFT having a gate electrically connected to the output end of the other output channel different from the one connected to the gate of switching TFT in the corresponding output channel group of the pixel driving unit, a source electrically connected to the anode of the OLED, and a drain outputting a sensing signal; the storage capacitor having a first end electrically connected to the gate of the driving TFT and a second end electrically connected to the drain of the driving TFT; the OLED having a cathode connected to a low power voltage;

the selection signal being at a high voltage, the output end of each first multiplex module outputting the first power signal, and the output end of each second multiplex module outputting the second power signal.

According to a preferred embodiment of the present invention, the number of the first multiplex modules and the number of the second multiplex modules are both one.

According to a preferred embodiment of the present invention, the number of the first multiplex modules and the number of the second multiplex module are both plural, and each first multiplex module and each second multiplex module is connected to one output channel correspondingly.

According to a preferred embodiment of the present invention, the scan signal outputted by each row of output channels is a signal generated after the row of output channel uses signal at the power end to perform level shifting on the input pulse signal received by the input end of the row of output channel.

The present invention also provides a scan driving circuit, which comprises: an output module, the output module comprising a plurality of rows of output channels successively arranged, at least a first multiplex module, and at least a second multiplex module;

number of the first multiplex modules and number of second multiplex modules being equal;

each row of output channels comprising: an input end, a power end, and an output end, with the input end of each row of output channels connected to an input pulse signal corresponding to the row of output channels, the output end outputting a corresponding scan signal of the row of output channels, the power end of the (4m−3)-th row of output channels receiving a first power signal, the power end of the (4m−2)-th row of output channels receiving an output end of one first multiplex module, the power end of the (4m−1)-th row of output channels receiving an output end of one second multiplex module, and the power end of the 4m-th row of output channel receiving a second power signal, m being a positive integer;

each first multiplex module having a control end receiving a selection signal, a first input end receiving the first power signal, and a second input end receiving the second power signal; each second multiplex module having a control end receiving a selection signal, a first input end receiving the first power signal, and a second input end receiving the second power signal; each selection signal controlling the output end of each first multiplex module to output one of the first power signal and the second power signal, and controlling the output end of the second multiplex modules to output the other of the first power signal and the second power signal different from the output of the first multiplex module;

the scan driving circuit further comprising: a shift register and a logical control unit electrically connected respectively to the shift register and the output module;

the shift register receiving a dock signal and a scan start signal for generating a plurality of input pulse signals outputted to the logic control unit according to the clock signal and the scan start signal;

the logic control unit receiving an enable signal for correspondingly inputting the plurality of input pulse signals into respective output channels of the output module according to the enable signal;

wherein the first power signal and the second power signal being both chamfered signals wherein the first power signal and the second power signal generating a chamfering cycle equal to twice the period of the clock signal, and two adjacent chamfers located respectively on the first power signal and the second power signal differing by a cycle of one clock signal, and rising edge of each chamfer being generated correspondingly to a rising edge of the clock signal;

wherein the scan driving circuit being configured to electrically connect to a pixel array, the pixel array comprising a plurality of pixel driving units arranged in an array.

The present invention provides the following advantages: the present invention provides a scan driving circuit comprising: a plurality of rows of output channels successively arranged, at least a first multiplex module, and at least a second multiplex module; each row of output channels comprising: an input end, a power end, and an output end, with the input end of each row of output channels connected to an input pulse signal corresponding to the row of output channels, the output end outputting a corresponding scan signal of the row of output channels, the power end of the (4m−3)-th row of output channels receiving a first power signal, the power end of the (4m−2)-th row of output channels receiving an output end of one first multiplex module, the power end of the (4m−1)-th row of output channels receiving an output end of one second multiplex module, and the power end of the 4m-th row of output channel receiving a second power signal; the first multiplex module and the second multiplex module having a control end receiving a selection signal, a first input end receiving the first power signal, and a second input end receiving the second power signal; the selection signal controlling the first multiplex module and the second multiplex module to change respective output power signal. As such, the present invention can change the power signal received by the output channel based on requirement, to guarantee the pre-charge effect as well as applicable to the requirements of various kinds of scanning sequences.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further illustrate the technical means taken by the present invention and resulted effects, the following detailed description is made in conjunction with the preferred embodiments of the present invention and the accompanying drawings.

Figure 1:
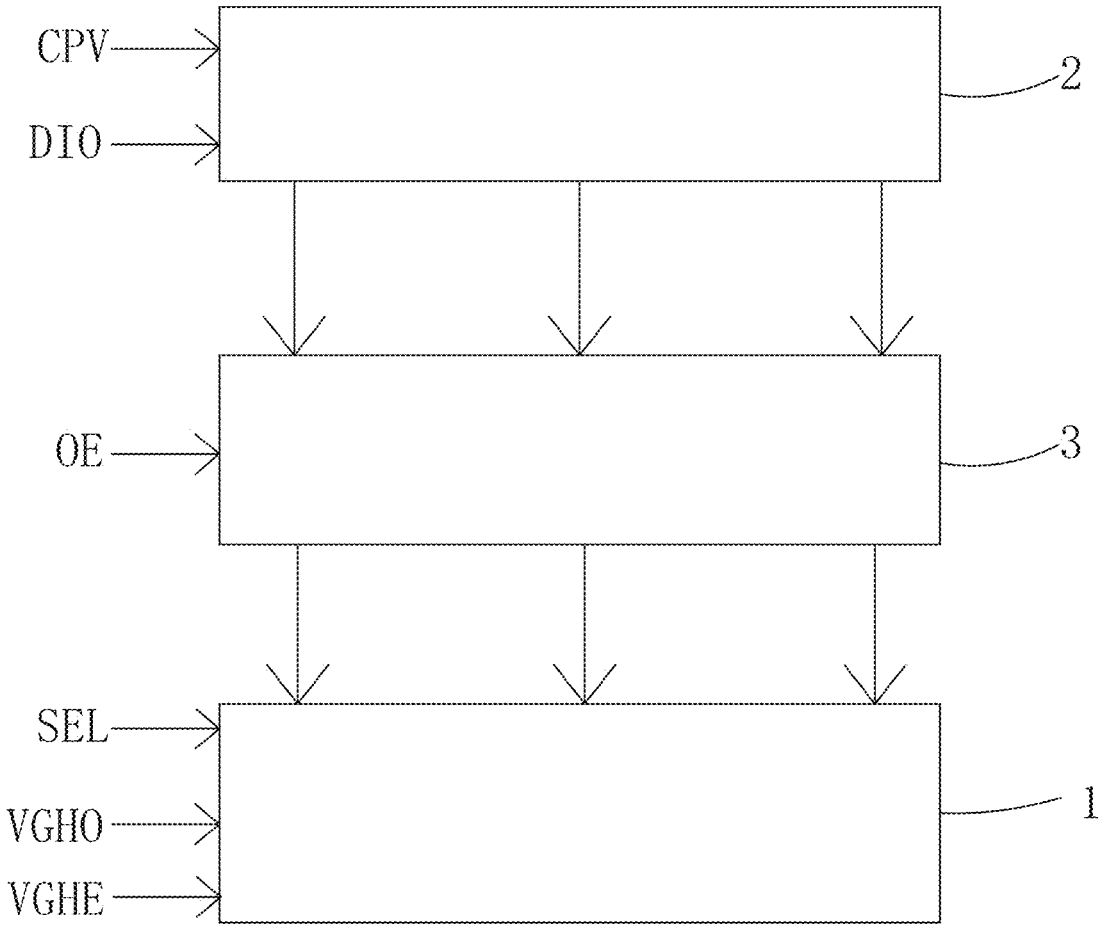
FIG. 1 is a schematic view showing the structure of the scan driving circuit provided by the present invention.
Figure 2:
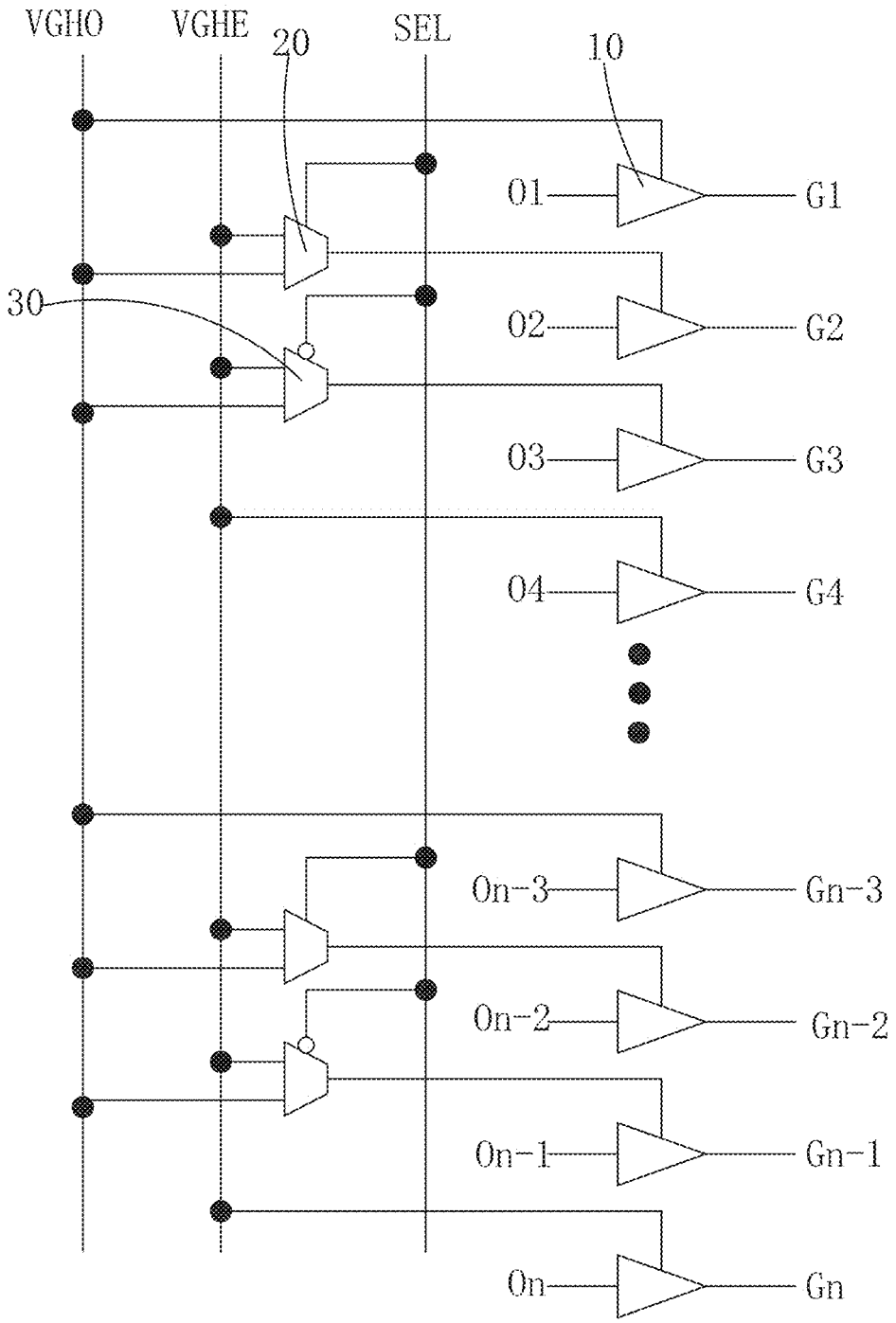
FIG. 2 is a schematic view showing the circuit between the first multiplex module, the second multiplex module and each output channel of the scan driving circuit provided by a first embodiment of the present invention.
Figure 3:
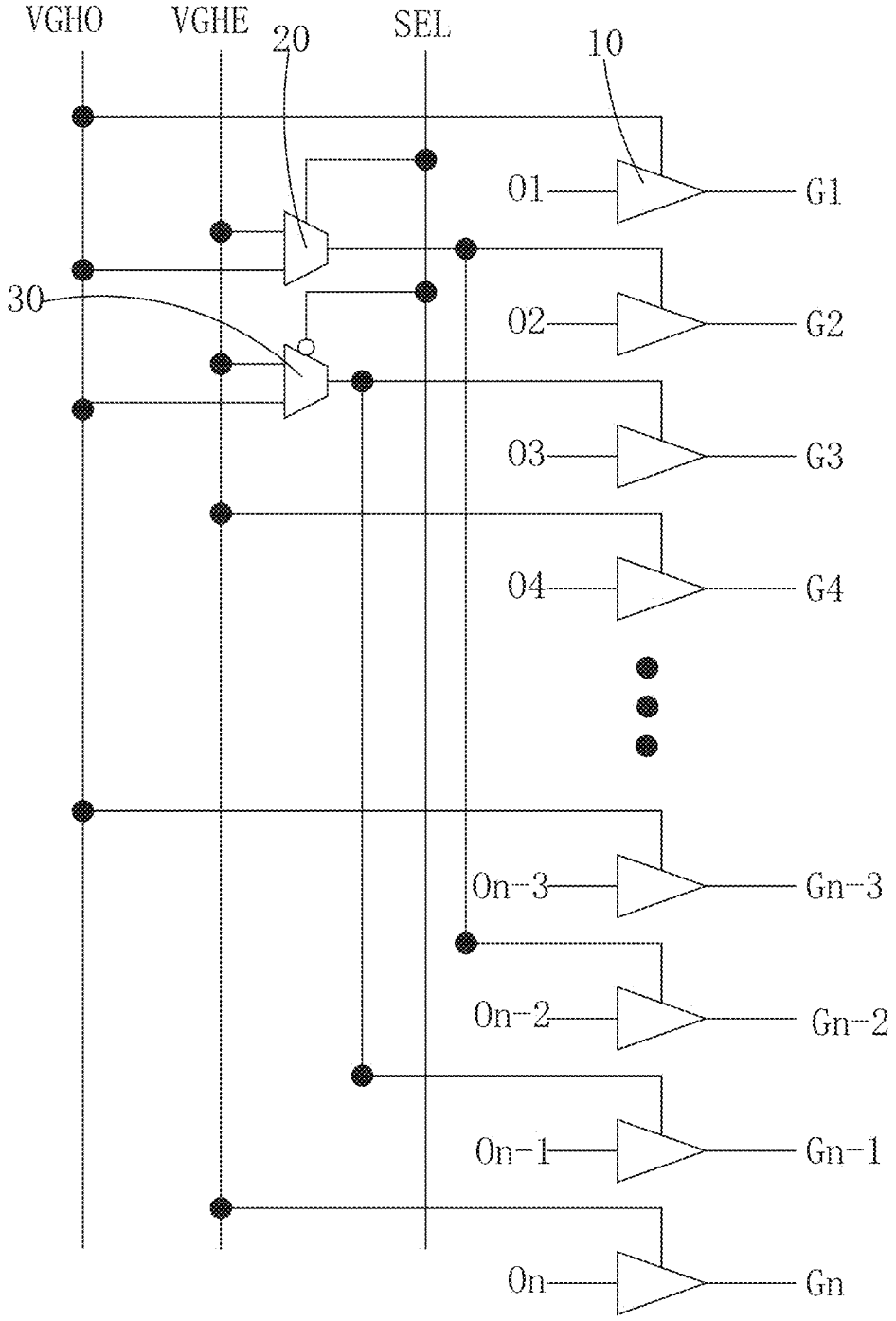
FIG. 3 is a schematic view showing the circuit between the first multiplex module, the second multiplex module and each output channel of the scan driving circuit provided by a second embodiment of the present invention.

Referring to FIGS. 1-3, the present invention provides a scan driving circuit, comprising an output module 1, the output module comprising a plurality of rows of output channels 10 successively arranged, at least a first multiplex module 20, and at least a second multiplex module 30.

Specifically, as shown in FIG. 2 and FIG. 3, each row of output channels 10 comprises: an input end, a power end, and an output end, with the input end of each row of output channels 10 connected to an input pulse signal corresponding to the row of output channels 10, the output end outputting a corresponding scan signal of the row of output channels 10. The scan signal outputted by each row of output channels 10 is a signal generated after the row of output channel 10 uses signal at the power end to perform level shifting on the input pulse signal received by the input end of the row of output channel 10. The level shifting is specifically a level raising. For example, as shown in FIG. 2, the the input end of the first row of output channels 10 receives the input pulse signal O1 of the first row, the output end outputs the scan signal G1 of the first row; the input end of the second row of output channel 10 receives the pulse signal O2 of the second row, and the output end outputs the scan signal G2 of the second row; the input end of the third row of output channels 10 receives the input pulse signal O3 of the third row, the output end outputs the scan signal G3 of the third row; the input end of the fourth row of output channels 10 receives the input pulse signal O4 of the fourth row, the output end outputs the scan signal G4 of the fourth row; the input end of the (n−3)th row of output channel 10 receives the input pulse signal On−3 of the (n−3)th row, and the output end outputs the scan signal Gn−3 of the (n−3)th row; the input end of the (n−2)th row of output channel 10 receives the input pulse signal On−2 of the (n−2)th row, and the output end outputs the scan signal Gn−2 of the (n−2)th row; the input end of the (n−1)th row of output channel 10 receives the input pulse signal On−1 of the (n−1)th row, and the output end outputs the scan signal Gn−1 of the (n−1)th row; the input end of the (n)th row of output channel 10 receives the input pulse signal On of the (n)th row, and the output end outputs the scan signal Gn of the (n)th row.

Specifically, as shown in FIG. 2 and FIG. 3, each first multiplex module 20 has a control end receiving a selection signal SEL, a first input end receiving the first power signal VGHO, and a second input end receiving the second power signal VGHE; each second multiplex module 30 has a control end receiving a selection signal SEL, a first input end receiving the first power signal VGHO, and a second input end receiving the second power signal VGHE. It should be noted that each selection signal SEL controls the output end of each first multiplex module 20 to output one of the first power signal VGHO and the second power signal VGHE, and controls the output end of the second multiplex module 30 to output the other of the first power signal VGHO and the second power signal VGHE different from the output of the first multiplex module 20.

Moreover, for positive integer m, the power end of the (4m−3)-th row of output channels 10 receives the first power signal VGHO, the power end of the (4m−2)-th row of output channels 10 receives the output end of one first multiplex module 20, the power end of the (4m−1)-th row of output channels 10 receives the output end of one second multiplex module 30, and the power end of the 4m-th row of output channels 10 receives the second power signal VGHE.

Specifically, refer to FIG. 2. In the first embodiment of the present invention, the number of the first multiplex modules 20 and the number of the second multiplex modules 30 are both plural, and each first multiplex module 20 and each second multiplex module 30 is connected to one output channel 10 correspondingly. In other words, each first multiplex module only connects to one output channel 10, and each second multiplex module 30 only connects to one output channel 10. Different output channels 10 are connected to different multiplex modules. As shown in FIG. 2, the second row of output channels 10 and the (n−2)th row of output channels 10 are connected to two different first multiplex modules 20, and the third row of output channels 10 and the (n−1)th row of output channels 10 are connected to two different second multiplex modules 30.

Specifically, refer to FIG. 3. In the second embodiment of the present invention, the number of the first multiplex module and the number of the first multiplex module are both 1. Each first multiplex module 20 and each second multiplex module 30 is connected to a plurality of output channels 10 correspondingly. As shown in FIG. 3, the second row of output channels 10 and the (n−2)th row of output channels 10 are connected to the first multiplex module 20, and the third row of output channels 10 and the (n−1)th row of output channels 10 are connected to the second multiplex module 30.

Specifically, as show in FIG. 1, the scan driving circuit of the present invention further comprises: a shift register 2 and a logical control unit 3 electrically connected respectively to the shift register 2 and the output module 1;

the shift register 2 receiving a dock signal CPV and a scan start signal DIO for generating a plurality of input pulse signals outputted to the logic control unit 3 according to the clock signal CPV and the scan start signal DIO;

the logic control unit 3 receiving an enable signal OE for correspondingly inputting the plurality of input pulse signals into respective output channels 10 of the output module 1 according to the enable signal OE.

Figure 5:
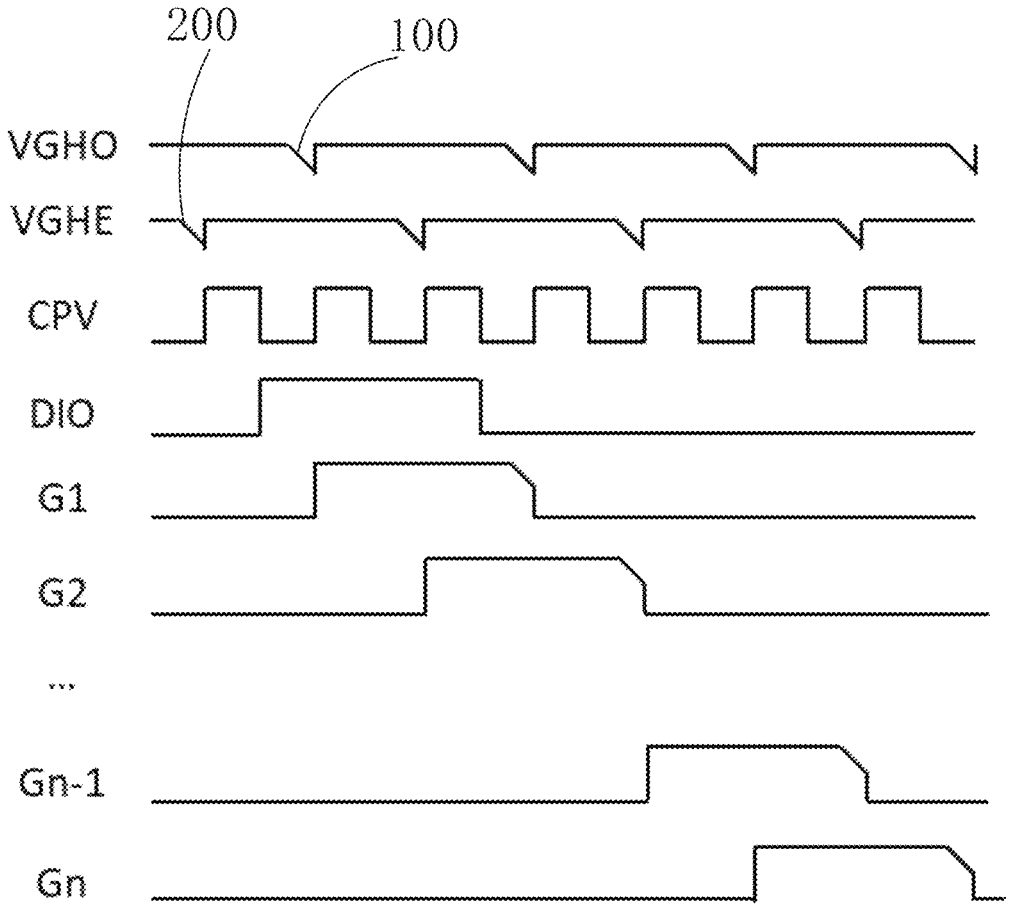
FIG. 5 is a schematic view showing the timing sequence of the pixel driving circuit electrically connected to the scan driving circuit provided by the present invention in FIG. 4.

It should be noted that the first power signal VGHO and the second power signal VGHE are both chamfered signals. That is, chamfers appear periodically in the waveforms of the first power signal VGHO and the second power signal VGHE. The period which the first power signal VGHO and the second power signal VGHE are chamfered is equal to twice the period of the clock signal CPV, and two adjacent chamfers located respectively on the first power signal VGHO and the second power signal VGHE differ by a cycle of one clock signal CPV, and rising edge of each chamfer is generated correspondingly to a rising edge of the clock signal CPV. For example, as shown in FIG. 5, the chamfer 100 on the first power signal VGHO and the chamfer 200 on the second power signal VGHE differ by one period of the clock signal CPV.

In actual application, the scan driving circuit of the present invention is configured to electrically connect to a pixel array, the pixel array comprises a plurality of pixel driving units arranged in an array. The pixel driving unit can be realized in various embodiments, and can adapt to the requirements of various kinds of scanning sequences by changing the selection signal of the scan driving circuit of the present invention. A typical pixel driving circuit comprises a 2T1C structure shown in FIG. 4 or a 3T1C structure shown in FIG. 6.

Figure 4:
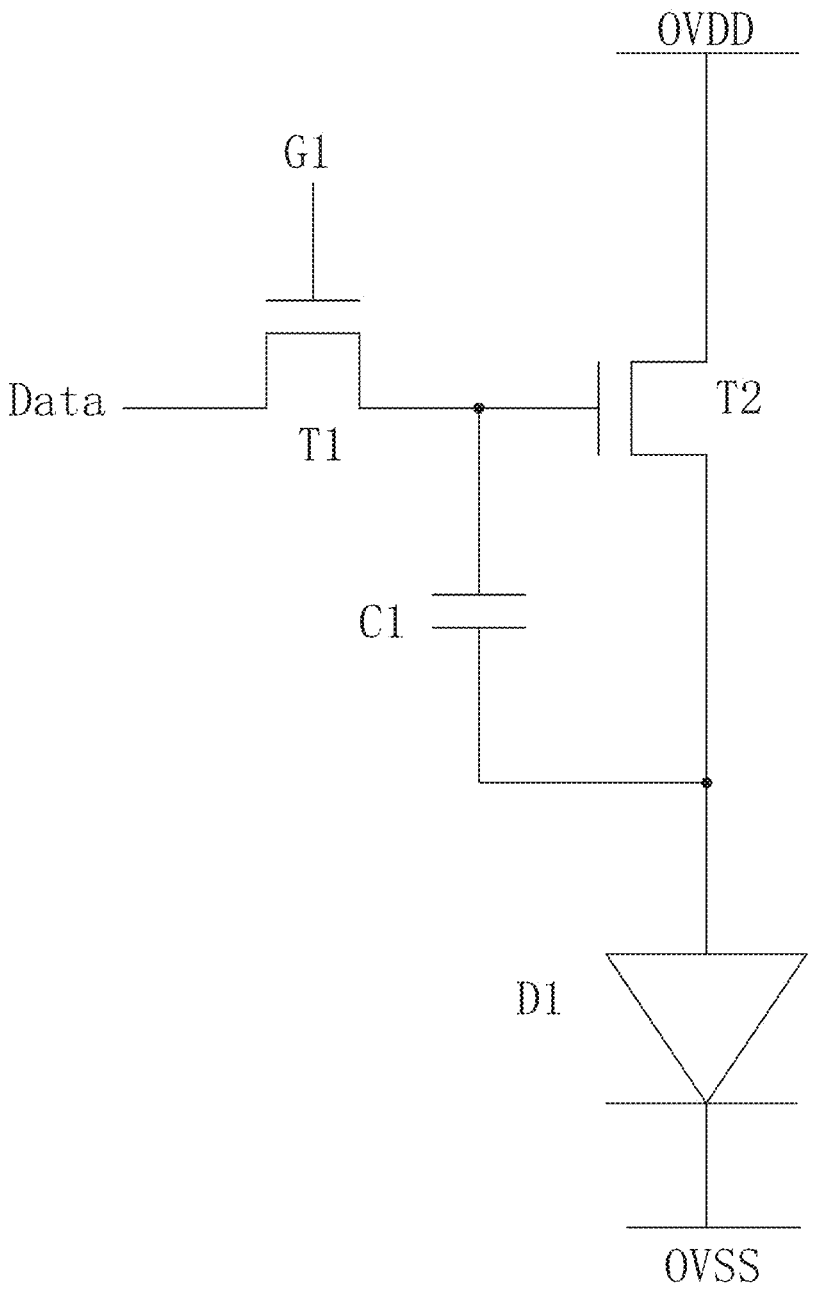
FIG. 4 is a schematic view showing the circuit of a first embodiment of the pixel driving circuit electrically connected to the scan driving circuit provided by the present invention.

Specifically, as shown in FIG. 4, the pixel driving unit of 2T1C structure comprises: a switching thin film transistor (TFT) T1, a driving TFT T2, a storage capacitor C1, and an organic light emitting diode (OLED) D1; the switching TFT T1 has a gate electrically connected to the output end of the corresponding output channel 10 of the pixel driving unit, a source receiving a data signal Data, and a drain electrically connected to a gate of the driving TFT T2; the driving TFT T2 has a source receiving a high power voltage OVDD, and a drain electrically connected to an anode of the OLED D1; the storage capacitor C1 has a first end electrically connected to the gate of the driving TFT T2 and a second end electrically connected to the drain of the driving TFT T2; the OLED D1 has a cathode connected to a low power voltage VSS.

In actual application, the connection between the scan driving circuit and the pixel array using the pixel driving unit of the 2T1C structure is as follows: the gates of the switching TFTs T1 in the pixel driving unit of the first row are all connected to receive the scan signal G1 outputted by the first row of output channels 10 of the scan driving circuit, the gates of the switching TFTs T1 in the pixel driving unit of the second row are all connected to receive the scan signal G2 outputted by the second row of output channels 10 of the scan driving circuit, the gates of the switching TFTs T1 in the pixel driving unit of the third row are all connected to receive the scan signal G3 outputted by the third row of output channels 10 of the scan driving circuit, and o on until the last row of pixel driving unit.

Moreover, as shown in FIG. 5, when the scan driving circuit drives the pixel driving unit of the 2T1C structure, the selection signal SEL is at a low voltage, the output end of each first multiplex module 20 outputs the second power signal VGHE, and the output end of each second multiplex module 30 outputs the first power signal VGHO. As such, the scan signals of the odd-numbered rows of pixel driving units are generated by the first power signal VGHO, and the scan signals of the even-numbered rows of pixel driving units are generated by the first power signal VGHE. As in FIG. 5, the overlapped portion of the high voltage pulses of the two adjacent scan signals is the stage where the next row of scan signals to pre-charge the corresponding pixel rows. For example, the overlapped portion of the first row scan signals G1 and the second row scan signals G2 is for the second row scan signal G2 to pre-charge the second row pixels. At this point, the first row scan signal G1 and the second row scan signal G2 are generated respectively by the first power signal VGHO and the second power signal VGHE.

Compared with generating the first row scan signal G1 and the second row scan scan signal G2 by the same power signal, the present invention can effectively avoid clipping of the scan signal in the pre-charging phase, so as to ensure that the chamfering occurs only in the charging phase and prevents pre-charge effect from decreasing due to chamfering.

Figure 6:
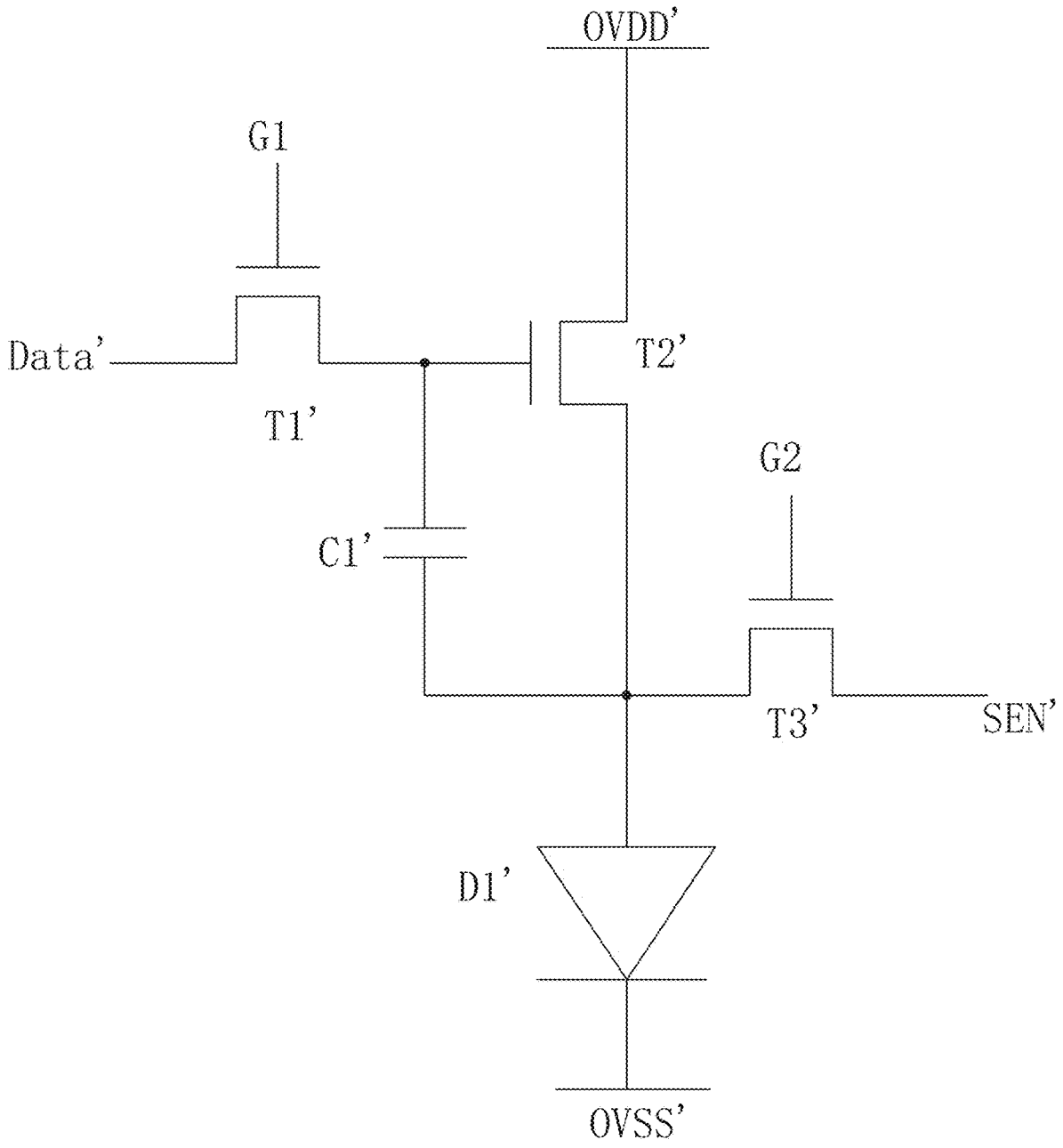
FIG. 6 is a schematic view showing the circuit of a second embodiment of the pixel driving circuit electrically connected to the scan driving circuit provided by the present invention.

Moreover, as shown in FIG. 6, the pixel driving unit of 3T1C structure comprises: a switching TFT T1', a driving TFT T2', a sensing TFT T3', storage capacitor C1', and an OLED D1'.

The pixel driving unit of the 3T1C structure needs two scan signals to respectively control the switching TFT T1' and the sensing TFT T3'. Therefore, the output channel 10 needs to be grouped, specifically: the plurality of rows of output channels 10 are divided into a plurality of output channel groups, with each output channel group having two adjacent rows of output channels 10 starting from the first row of output channels 10; each output channel group corresponding to one row of pixel driving units. For example, the first row of output channels 10 and the second row of output channels 10 are a group, the third row of output channels 10 and the fourth row of output channels 10 are a group, the fifth row of output channels 10 and the sixth row of output channels 10 are a group, and so on until the last row.

For connection, the switching TFT T1' has a gate electrically connected to the output end of one output channel 10 in the corresponding output channel group of the pixel driving unit, a source receiving a data signal Data', and a drain electrically connected to a gate of the driving TFT T2'; the driving TFT T2' has a source receiving a high power voltage OVDD', and a drain electrically connected to an anode of the OLED D1'; the sensing TFT T3' has a gate electrically connected to the output end of the other output channel 10 different from the one connected to the gate of switching TFT T1' in the corresponding output channel group of the pixel driving unit, a source electrically connected to the anode of the OLED D1', and a drain outputting a sensing signal SEN'; the storage capacitor C1' has a first end electrically connected to the gate of the driving TFT T2' and a second end electrically connected to the drain of the driving TFT T2'; the OLED D1' has a cathode connected to a low power voltage OVSS'. For example, in the first row pixel driving unit, the gate of the switching TFT T1' is electrically connected to the output end of the first row of output channels 10, the gate of the sensing TFT T3' is electrically connected to the second row of output channels 10; in the second row pixel driving unit, the gate of the switching TFT T1' in the second row pixel driving unit is electrically connected to the output end of the third row of the output channels 10, the gate of the sensing TFT T3' is electrically connected to the fourth row of output channels 10; and so on until the last row.

Figure 7:
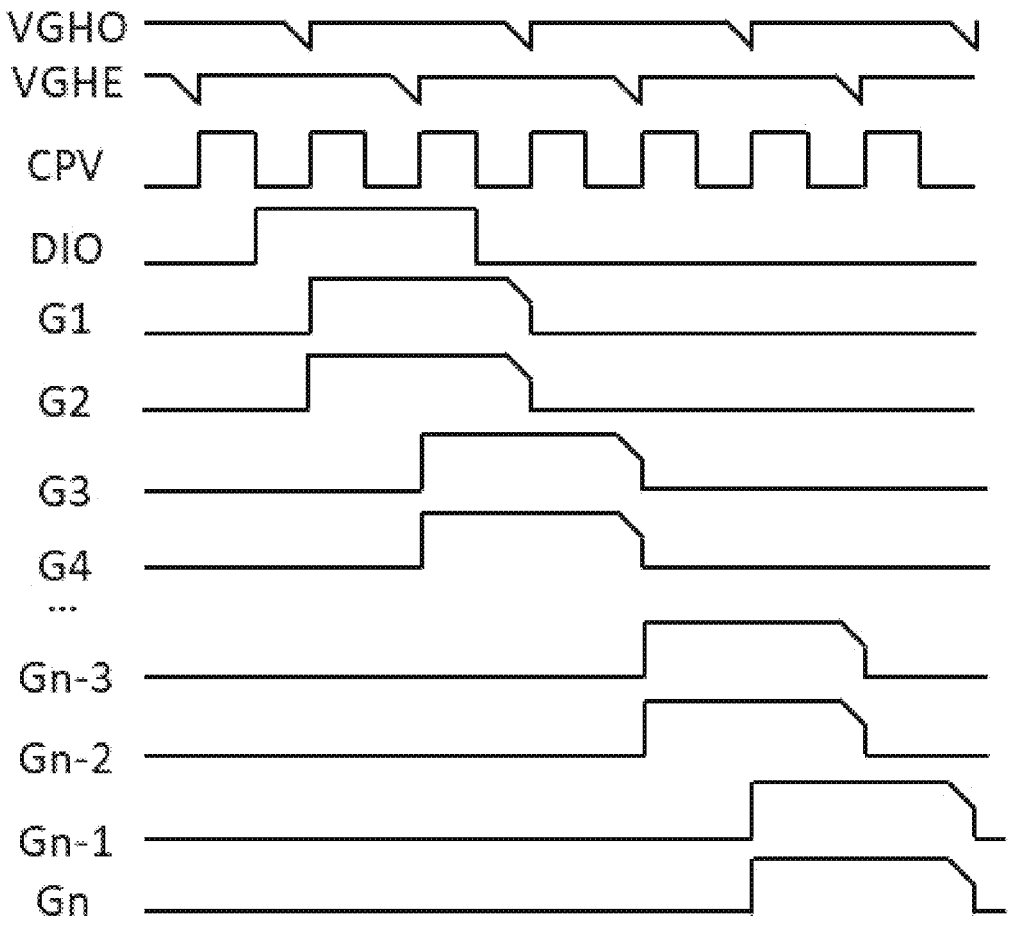
FIG. 7 is a schematic view showing the timing sequence of the pixel driving circuit electrically connected to the scan driving circuit provided by the present invention in FIG. 6.

Refer to FIG. 7. When driven, the selection signal SEL is at a high voltage, the output end of each first multiplex module 20 outputs the first power signal VGHO, and the output end of each second multiplex module 30 outputs the second power signal VGHE to guarantee that the output channels 10 in the same output channel group are receiving the same power signal to avoid the chamfering in the scan signal in the pre-charging phase. As such, the present invention ensures the chamfering occurs only in the charging phase and prevents pre-charge effect from decreasing due to chamfering.

In summary, the present invention provides a scan driving circuit comprising: a plurality of rows of output channels successively arranged, at least a first multiplex module, and at least a second multiplex module; each row of output channels comprising: an input end, a power end, and an output end, with the input end of each row of output channels connected to an input pulse signal corresponding to the row of output channels, the output end outputting a corresponding scan signal of the row of output channels, the power end of the (4m−3)-th row of output channels receiving a first power signal, the power end of the (4m−2)-th row of output channels receiving an output end of one first multiplex module, the power end of the (4m−1)-th row of output channels receiving an output end of one second multiplex module, and the power end of the 4m-th row of output channel receiving a second power signal; the first multiplex module and the second multiplex module having a control end receiving a selection signal, a first input end receiving the first power signal, and a second input end receiving the second power signal; the selection signal controlling the first multiplex module and the second multiplex module to change respective output power signal. As such, the present invention can change the power signal received by the output channel based on requirement, to guarantee the pre-charge effect as well as applicable to the requirements of various kinds of scanning sequences.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A scan driving circuit, comprising: an output module, the output module comprising a plurality of rows of output channels successively arranged, at least a first multiplex module, and at least a second multiplex module;

number of the first multiplex modules and number of second multiplex modules being equal;

each row of output channels comprising: an input end, a power end, and an output end, with the input end of each row of output channels connected to an input pulse signal corresponding to the row of output channels, the output end outputting a corresponding scan signal of the row of output channels, the power end of the (4m−3)-th row of output channels receiving a first power signal, the power end of the (4m−2)-th row of output channels receiving an output end of one first multiplex module, the power end of the (4m−1)-th row of output channels receiving an output end of one second multiplex module, and the power end of the 4m-th row of output channel receiving a second power signal, m being a positive integer;

each first multiplex module having a control end receiving a selection signal, a first input end receiving the first power signal, and a second input end receiving the second power signal; each second multiplex module having a control end receiving a selection signal, a first input end receiving the first power signal, and a second input end receiving the second power signal; each selection signal controlling the output end of each first multiplex module to output one of the first power signal and the second power signal, and controlling the output end of the second multiplex modules to output the other of the first power signal and the second power signal different from the output of the first multiplex module.

2. The scan driving circuit as claimed in claim 1, further comprising: a shift register and a logical control unit electrically connected respectively to the shift register and the output module;

the shift register receiving a clock signal and a scan start signal for generating a plurality of input pulse signals outputted to the logic control unit according to the dock signal and the scan start signal;

the logic control unit receiving an enable signal for correspondingly inputting the plurality of input pulse signals into respective output channels of the output module according to the enable signal.

3. The scan driving circuit as claimed in claim 2, wherein the first power signal and the second power signal are both chamfered signals.

4. The scan driving circuit as claimed in claim 3, wherein the first power signal and the second power signal generate a chamfering cycle equal to twice the period of the clock signal, and two adjacent chamfers located respectively on the first power signal and the second power signal differ by a cycle of one dock signal, and rising edge of each chamfer is generated correspondingly to a rising edge of the dock signal.

5. The scan driving circuit as claimed in claim 1, wherein the scan driving circuit is configured to electrically connect to a pixel array, the pixel array comprises a plurality of pixel driving units arranged in an array.

6. The scan driving circuit as claimed in claim 5, wherein each output channel corresponds to a row of pixel driving units, with each pixel driving unit comprising a switching thin film transistor (TFT), a driving TFT, a storage capacitor, and an organic light emitting diode (OLED);

the switching TFT having a gate electrically connected to the output end of the corresponding output channel of the pixel driving unit, a source receiving a data signal, and a drain electrically connected to a gate of the driving TFT; the driving TFT having a source receiving a high power voltage, and a drain electrically connected to an anode of the OLED; the storage capacitor having a first end electrically connected to the gate of the driving TFT and a second end electrically connected to the drain of the driving TFT; the OLED having a cathode connected to a low power voltage;

the selection signal being at a low voltage, the output end of each first multiplex module outputting the second power signal, and the output end of each second multiplex module outputting the first power signal.

7. The scan driving circuit as claimed in claim 5, wherein he plurality of rows of output channels are divided into a plurality of output channel groups, with each output channel group having two adjacent rows of output channels starting from the first row of output channels; each output channel group corresponding to one row of pixel driving units;

each pixel driving unit comprising a switching TFT, a driving TFT, a sensing TFT, a storage capacitor, and an OLED;

the switching TFT having a gate electrically connected to the output end of one output channel in the corresponding output channel group of the pixel driving unit, a source receiving a data signal, and a drain electrically connected to a gate of the driving TFT; the driving TFT having a source receiving a high power voltage, and a drain electrically connected to an anode of the OLED; the sensing TFT having a gate electrically connected to the output end of the other output channel different from the one connected to the gate of switching TFT in the corresponding output channel group of the pixel driving unit, a source electrically connected to the anode of the OLED, and a drain outputting a sensing signal; the storage capacitor having a first end electrically connected to the gate of the driving TFT and a second end electrically connected to the drain of the driving TFT; the OLED having a cathode connected to a low power voltage;

the selection signal being at a high voltage, the output end of each first multiplex module outputting the first power signal, and the output end of each second multiplex module outputting the second power signal.

8. The scan driving circuit as claimed in claim 1, wherein the number of the first multiplex modules and the number of the second multiplex modules are both one.

9. The scan driving circuit as claimed in claim 1, wherein the number of the first multiplex modules and the number of the second multiplex module are both plural, and each first multiplex module and each second multiplex module is connected to one output channel correspondingly.

10. The scan driving circuit as claimed in claim 1, wherein the scan signal outputted by each row of output channels is a signal generated after the row of output channel uses signal at the power end to perform level shifting on the input pulse signal received by the input end of the row of output channel.

11. A scan driving circuit, comprising: an output module, the output module comprising a plurality of rows of output channels successively arranged, at least a first multiplex module, and at least a second multiplex module;

number of the first multiplex modules and number of second multiplex modules being equal;

each row of output channels comprising: an input end, a power end, and an output end, with the input end of each row of output channels connected to an input pulse signal corresponding to the row of output channels, the output end outputting a corresponding scan signal of the row of output channels, the power end of the (4m−3)-th row of output channels receiving a first power signal, the power end of the (4m−2)-th row of output channels receiving an output end of one first multiplex module, the power end of the (4m−1)-th row of output channels receiving an output end of one second multiplex module, and the power end of the 4m-th row of output channel receiving a second power signal, m being a positive integer;

each first multiplex module having a control end receiving a selection signal, a first input end receiving the first power signal, and a second input end receiving the second power signal; each second multiplex module having a control end receiving a selection signal, a first input end receiving the first power signal, and a second input end receiving the second power signal; each selection signal controlling the output end of each first multiplex module to output one of the first power signal and the second power signal, and controlling the output end of the second multiplex modules to output the other of the first power signal and the second power signal different from the output of the first multiplex module;

further comprising: a shift register and a logical control unit electrically connected respectively to the shift register and the output module;

the shift register receiving a clock signal and a scan start signal for generating a plurality of input pulse signals outputted to the logic control unit according to the clock signal and the scan start signal;

the logic control unit receiving an enable signal for correspondingly inputting the plurality of input pulse signals into respective output channels of the output module according to the enable signal;

wherein the first power signal and the second power signal being both chamfered signals;

wherein the first power signal and the second power signal generating a chamfering cycle equal to twice the period of the clock signal, and two adjacent chamfers located respectively on the first power signal and the second power signal differing by a cycle of one clock signal, and rising edge of each chamfer being generated correspondingly to a rising edge of the clock signal;

wherein the scan driving circuit being configured to electrically connect to a pixel array, the pixel array comprising a plurality of pixel driving units arranged in an array.

12. The scan driving circuit as claimed in claim 11, wherein each output channel corresponds to a row of pixel driving units, with each pixel driving unit comprising a switching thin film transistor (TFT), a driving TFT, a storage capacitor, and an organic light emitting diode (OLED);

the switching TFT having a gate electrically connected to the output end of the corresponding output channel of the pixel driving unit, a source receiving a data signal, and a drain electrically connected to a gate of the driving TFT; the driving TFT having a source receiving a high power voltage, and a drain electrically connected to an anode of the OLED; the storage capacitor having a first end electrically connected to the gate of the driving TFT and a second end electrically connected to the drain of the driving TFT; the OLED having a cathode connected to a low power voltage;

the selection signal being at a low voltage, the output end of each first multiplex module outputting the second power signal, and the output end of each second multiplex module outputting the first power signal.

13. The scan driving circuit as claimed in claim 11, wherein he plurality of rows of output channels are divided into a plurality of output channel groups, with each output channel group having two adjacent rows of output channels starting from the first row of output channels; each output channel group corresponding to one row of pixel driving units;

each pixel driving unit comprising a switching TFT, a driving TFT, a sensing TFT, a storage capacitor, and an OLED;

the switching TFT having a gate electrically connected to the output end of one output channel in the corresponding output channel group of the pixel driving unit, a source receiving a data signal, and a drain electrically connected to a gate of the driving TFT; the driving TFT having a source receiving a high power voltage, and a drain electrically connected to an anode of the OLED; the sensing TFT having a gate electrically connected to the output end of the other output channel different from the one connected to the gate of switching TFT in the corresponding output channel group of the pixel driving unit, a source electrically connected to the anode of the OLED, and a drain outputting a sensing signal; the storage capacitor having a first end electrically connected to the gate of the driving TFT and a second end electrically connected to the drain of the driving TFT; the OLED having a cathode connected to a low power voltage;

the selection signal being at a high voltage, the output end of each first multiplex module outputting the first power signal, and the output end of each second multiplex module outputting the second power signal.

14. The scan driving circuit as claimed in claim 11, wherein the number of the first multiplex modules and the number of the second multiplex modules are both one.

15. The scan driving circuit as claimed in claim 11, wherein the number of the first multiplex modules and the number of the second multiplex module are both plural, and each first multiplex module and each second multiplex module is connected to one output channel correspondingly.

16. The scan driving circuit as claimed in claim 11, wherein the scan signal outputted by each row of output channels is a signal generated after the row of output channel uses signal at the power end to perform level shifting on the input pulse signal received by the input end of the row of output channel.

* * * * *